US006193233B1

(12) United States Patent
Lipman

(10) Patent No.: US 6,193,233 B1
(45) Date of Patent: Feb. 27, 2001

(54) DICE GAME

(76) Inventor: Michael Lipman, 112 Ashurst Drive, Gants Hill, Ilford, Essex, IG6 1AQ (GB)

( * ) Notice: Subject to any disclaimer, the term of this patent is extended or adjusted under 35 U.S.C. 154(b) by 0 days.

(21) Appl. No.: 09/489,562

(22) Filed: Jan. 21, 2000

(51) Int. Cl.[7] ..... A63B 7/00

(52) U.S. Cl. ..... 273/138.1; 273/138 R; 273/146; 273/268

(58) Field of Search ..... 273/138.1, 138 R, 273/146, 268, 272, 299, 274, 145 R, 145 A, 145 B, 145 C, 145 D, 145 E, 145 CA

(56) References Cited

U.S. PATENT DOCUMENTS

D. 209,297 * 11/1967 Hulser ..... D34/5
D. 262,725 * 1/1982 Rice ..... D21/41
D. 383,799 * 9/1997 Beaumier et al. ..... D21/41
D. 389,874 * 1/1998 Kazangian ..... D21/41
2,528,029 * 10/1950 Brown ..... 273/93
3,734,501 * 5/1973 La Monica ..... 273/93 R
4,708,344 * 11/1987 Wyatt ..... 273/93 R
4,921,251 * 5/1990 Kanenwisher ..... 273/93 R
5,046,743 * 9/1991 Salerno ..... 273/247
5,234,218 * 8/1993 LaRocca ..... 273/245
6,047,967 * 4/2000 Murphy et al. ..... 273/245
6,068,259 * 5/2000 Dolin ..... 273/244

* cited by examiner

*Primary Examiner*—Mark S. Graham
*Assistant Examiner*—Dolores R. Collins

(57) ABSTRACT

A dice game for simulating a wide variety of sports. The dice game includes a plurality dice. The plurality of dice is at least one pair of dice. A first pair of the dice has action indicia thereon representative of a game of soccer. The dice game is played according to the rules of soccer.

6 Claims, 6 Drawing Sheets

DICE GAME

BACKGROUND OF THE INVENTION

1. Field of the Invention

The present invention relates to games and more particularly pertains to a new dice game for simulating a wide variety of sports.

2. Description of the Prior Art

The use of games is known in the prior art. More specifically, games heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,046,743; U.S. Pat. No. 5,224,710; U.S. Des. Pat. No. 389,874; U.S. Des. Pat. No. 262,725; U.S. Des. Pat. No. 383,799; and U.S. Des. Pat. No. 209,297.

While these devices fulfill their respective, particular objectives and requirements, the aforementioned patents do not disclose a new dice game. The inventive device includes a plurality dice. The plurality of dice is at least one pair of dice. A first pair of the dice has action indicia thereon representative of a game of soccer. The dice game is played according to the rules of soccer.

In these respects, the dice game according to the present invention substantially departs from the conventional concepts and designs of the prior art, and in so doing provides an apparatus primarily developed for the purpose of simulating a wide variety of sports.

SUMMARY OF THE INVENTION

In view of the foregoing disadvantages inherent in the known types of games now present in the prior art, the present invention provides a new dice game construction wherein the same can be utilized for simulating a wide variety of sports.

The general purpose of the present invention, which will be described subsequently in greater detail, is to provide a new dice game apparatus and method which has many of the advantages of the games mentioned heretofore and many novel features that result in a new dice game which is not anticipated, rendered obvious, suggested, or even implied by any of the prior art games, either alone or in any combination thereof.

To attain this, the present invention generally comprises a plurality dice. The plurality of dice is at least one pair of dice. A first pair of the dice has action indicia thereon representative of a game of soccer. The dice game is played according to the rules of soccer.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new dice game apparatus and method which has many of the advantages of the games mentioned heretofore and many novel features that result in a new dice game which is not anticipated, rendered obvious, suggested, or even implied by any of the prior art games, either alone or in any combination thereof.

It is another object of the present invention to provide a new dice game which may be easily and efficiently manufactured and marketed.

It is a further object of the present invention to provide a new dice game which is of a durable and reliable construction.

An even further object of the present invention is to provide a new dice game which is susceptible of a low cost of manufacture with regard to both materials and labor, and which accordingly is then susceptible of low prices of sale to the consuming public, thereby making such dice game economically available to the buying public.

Still yet another object of the present invention is to provide a new dice game which provides in the apparatuses and methods of the prior art some of the advantages thereof, while simultaneously overcoming some of the disadvantages normally associated therewith.

Still another object of the present invention is to provide a new dice game for simulating a wide variety of sports.

Yet another object of the present invention is to provide a new dice game which includes a plurality dice. The plurality of dice is at least one pair of dice. A first pair of the dice has action indicia thereon representative of a game of soccer. The dice game is played according to the rules of soccer.

Still yet another object of the present invention is to provide a new dice game that can be adapted for playing a wide variety of simulated sports including football, tennis, hockey, basketball and baseball.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
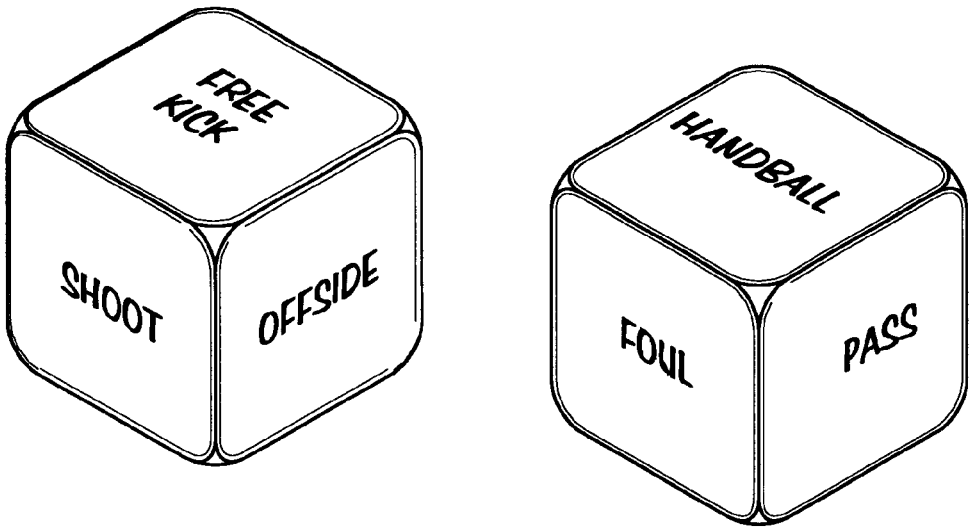
FIG. 1 is a schematic perspective view of the first soccer die of a new dice game according to the present invention.

With reference now to the drawings, and in particular to FIGS. 1 through 6 thereof, a new dice game embodying the principles and concepts of the present invention and generally designated by the reference numeral 12 will be described.

As best illustrated in FIGS. 1 through 12, the dice game 10 generally comprises a method of playing a dice game for using dice to simulate a multiplicity of sport games.

The game includes a plurality of pairs of dice.

Figure 2:
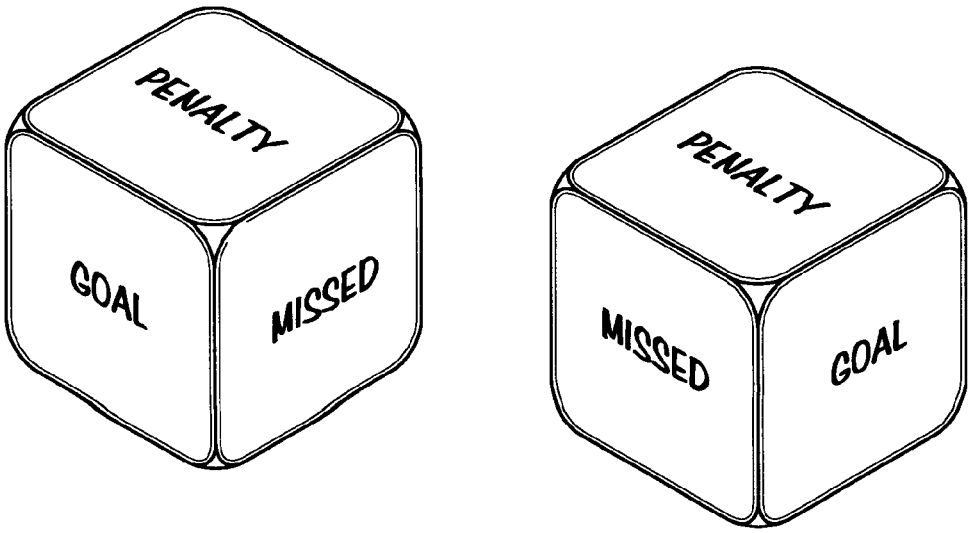
FIG. 2 is a schematic perspective view of the second soccer die of the present invention.

The dice of a first pair of dice, as best illustrated in FIGS. 1 and 2, each has action indicia thereon representative of a game of soccer and defining soccer dice. Each of the dice of the first pair is a six sided die. The action indicia on a first die of the first pair are selected from the group consisting of a free kick, an offside, a shot, a handball, a foul, and a pass. The action indicia on a second die of the first pair are selected from the group consisting of a penalty, a goal, and a miss.

Figure 3:
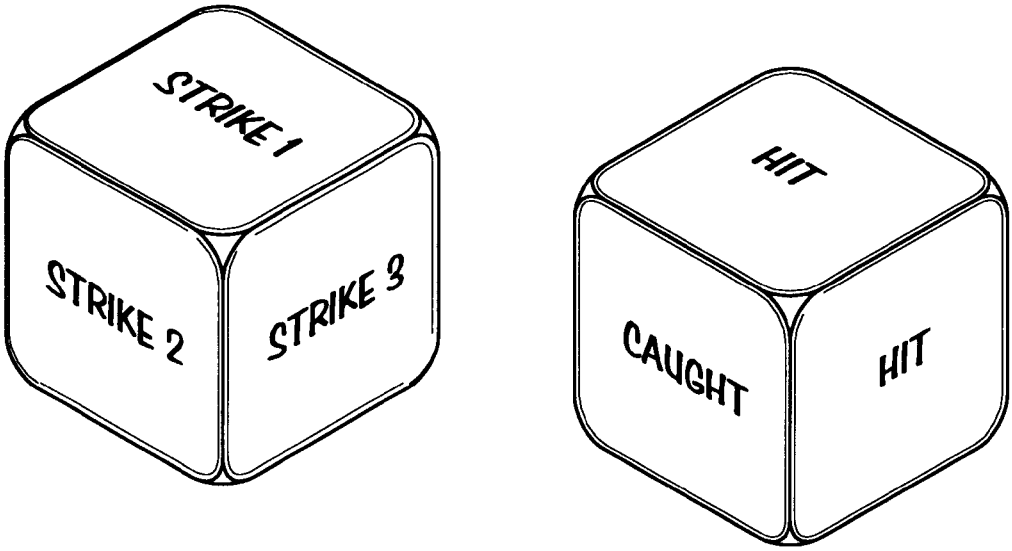
FIG. 3 is a schematic perspective view of the first baseball die of the present invention.
Figure 4:
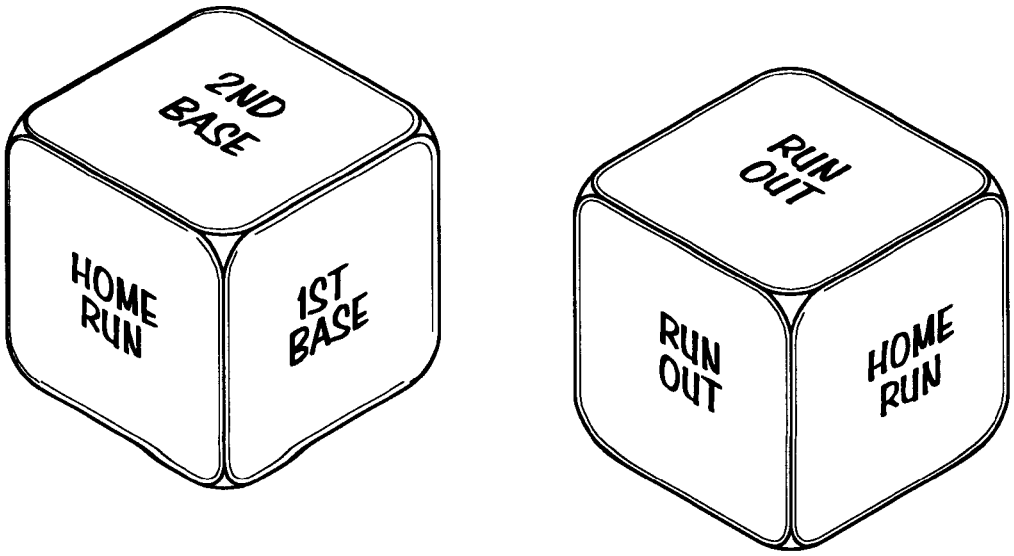
FIG. 4 is a schematic perspective view of the second baseball die of the present invention.

The dice of a second pair of dice, as best illustrated in FIGS. 3 and 4, each of the dice has action indicia thereon representative of a game of baseball and defining baseball dice. Each of the dice of the second pair is a six sided die. The action indicia on a first die of the second pair is selected from the group consisting of a first strike, a second strike, a third strike, a hit, and a catch. The action indicia on a second die of the second pair is selected from the group consisting of a home run, a two-base hit, a second-base hit, force out, home run.

Figure 5:
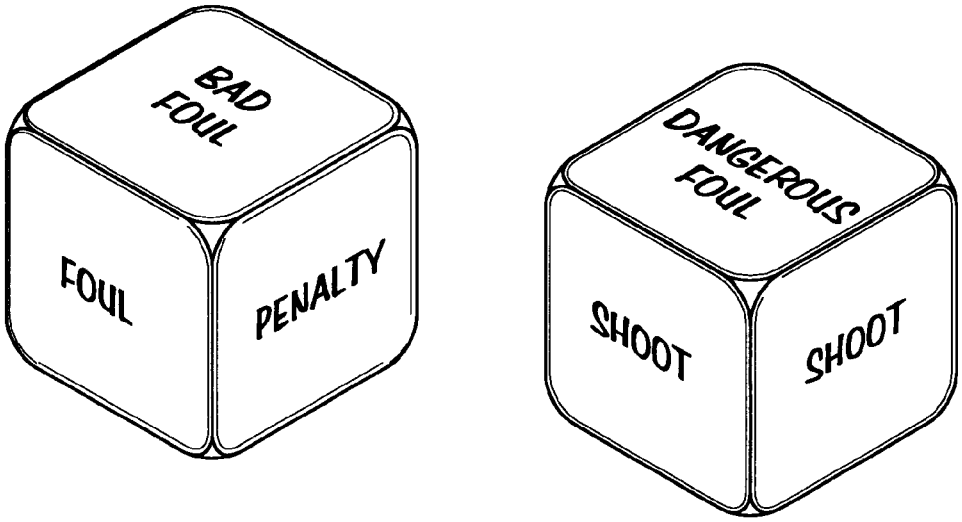
FIG. 5 is a schematic perspective view of the first basketball die of the present invention.
Figure 6:
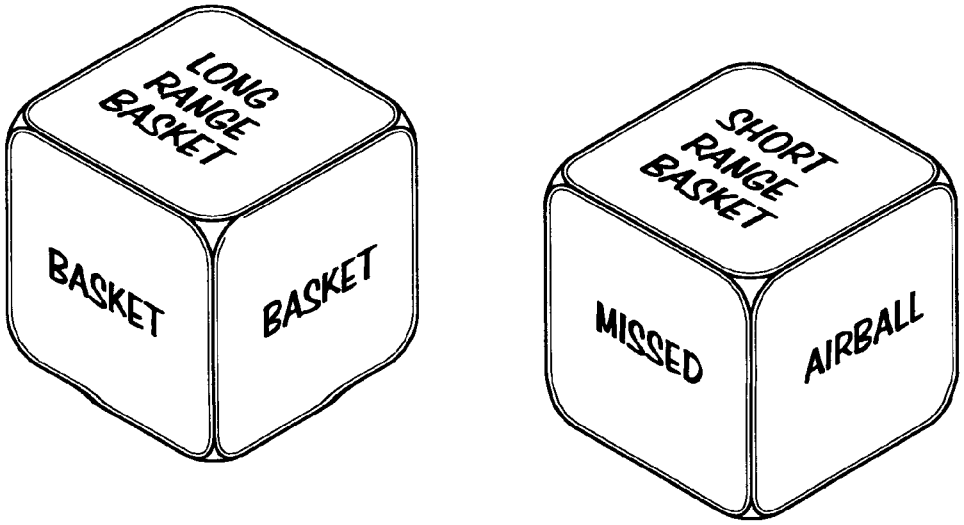
FIG. 6 is a schematic perspective view of the second basketball die of the present invention.

The dice of a third pair of dice, as best illustrated in FIGS. 5 and 6, each has action indicia thereon representative of a game of basketball and defining basketball dice. Each of the dice of the third pair is a six sided die. The action indicia on a first die of the third pair are selected from the group consisting of a foul, a bad foul, a dangerous foul, a penalty, and a shot. The action indicia on a second die of the third pair are selected from the group consisting of a long range basket, a basket, a short range basket, a miss and an air-ball.

Figure 7:
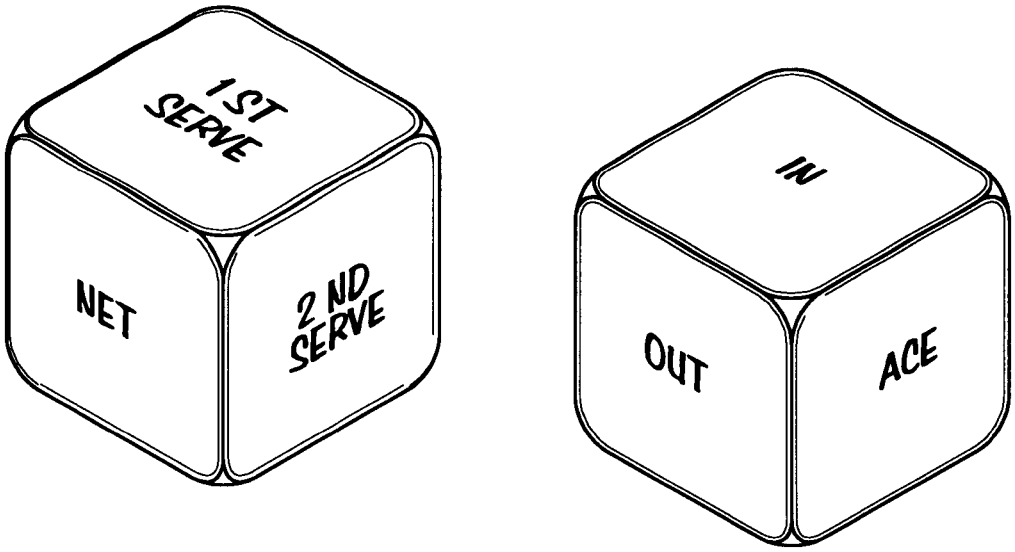
FIG. 7 is a schematic perspective view of the first tennis die of a new dice game according to the present invention.
Figure 8:
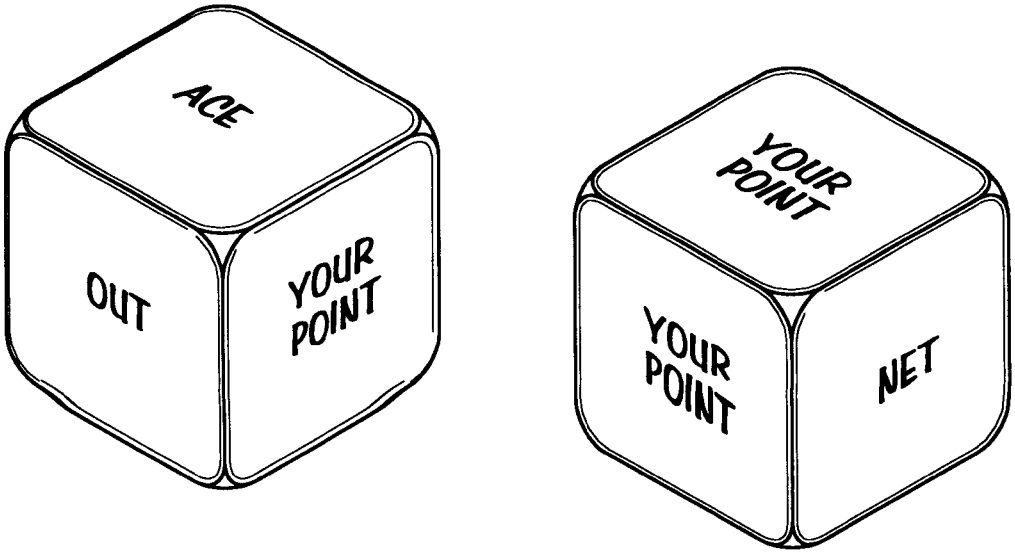
FIG. 8 is a schematic perspective view of the second tennis die of the present invention.

The dice of a fourth pair of dice, as best illustrated in FIGS. 7 and 8, each has action indicia thereon representative of a game of tennis and defining tennis dice. Each of the dice of the fourth pair is a six sided die. The action indicia on a first die of the fourth pair are selected from the group consisting of a first serve, a second serve, a hit net, an in bounds shot, an out of bounds shot and an ace. The action indicia on a second die of the fourth pair are selected from the group consisting of an ace, an out of bounds shot, a point, and a hit net.

Figure 10:
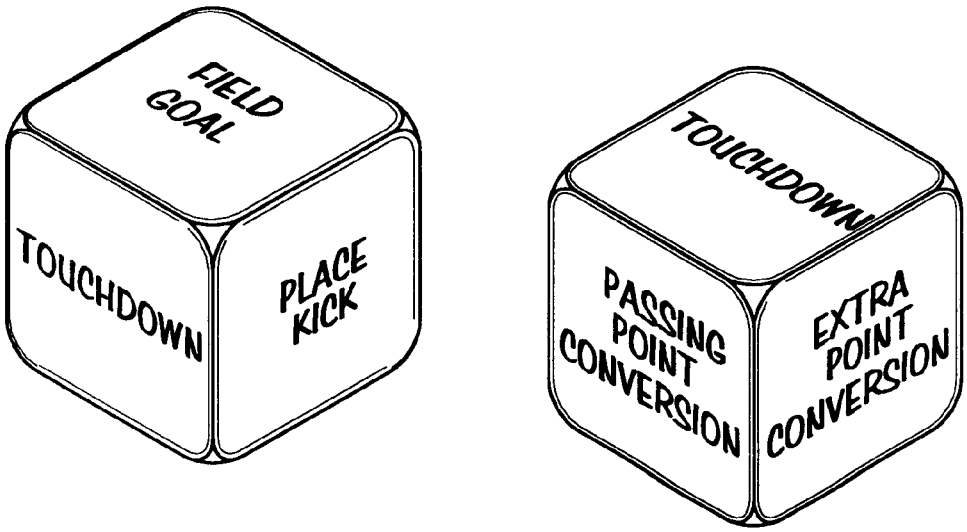
FIG. 10 is a schematic perspective view of the second hockey die of the present invention.
Figure 11:
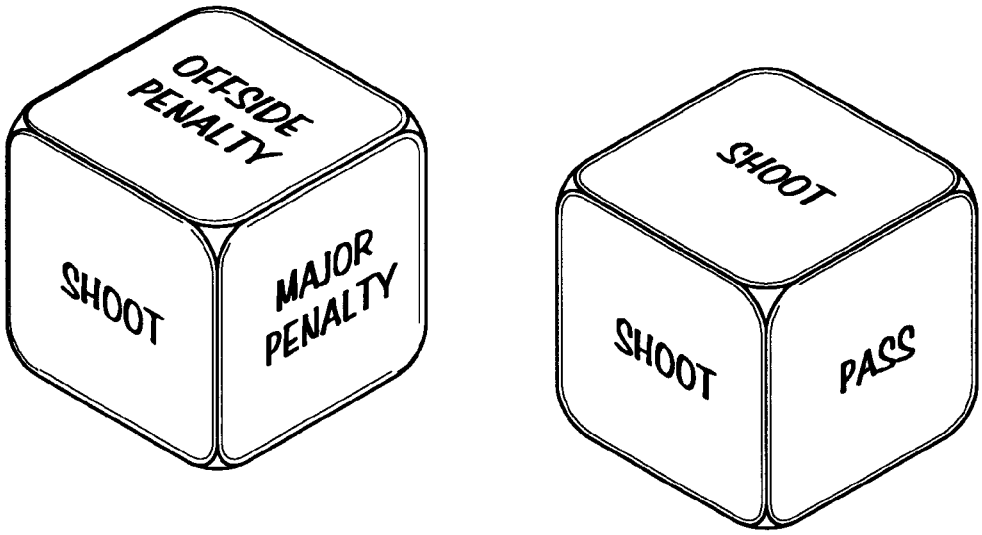
FIG. 11, is a schematic perspective view of the first football die of the present invention.
Figure 12:
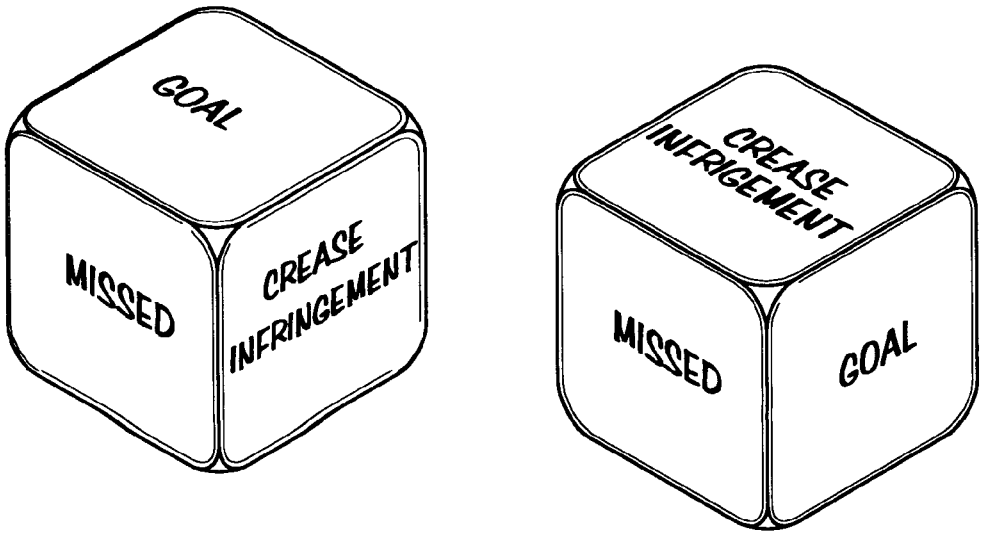
FIG. 12 is a schematic perspective view of the second football die of the present invention.

The dice of a fifth pair of dice, as best illustrated in FIGS. 10 and 11, each has action indicia thereon representative of a game of football and defining football dice. Each of the dice of the fifth pair is a six sided die. The action indicia on a first die of the fifth pair are selected from the group consisting of a pass reception, a downed ball, going for touchdown, failed fourth down conversion and a safety. The action indicia on a second die of the fifth pair are selected from the group consisting of a field goal, a place kick, a touchdown, a passing point conversion, and an extra point conversion.

Figure 9:
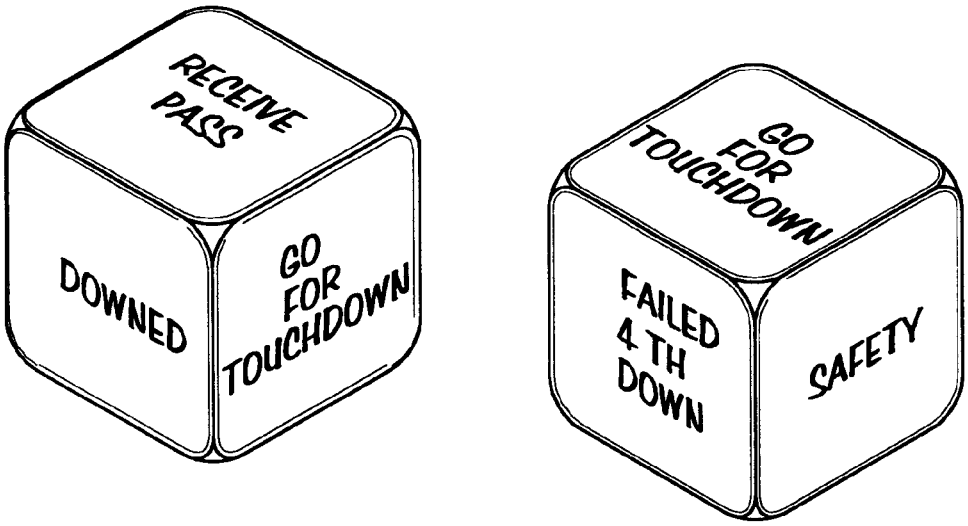
FIG. 9 is a schematic perspective view of the first hockey die of the present invention.

The dice of a sixth pair of dice, as best illustrated in FIGS. 9 and 10, each has action indicia thereon representative of a game and defining hockey dice. Each of the dice of the sixth pair is a six sided die. The action indicia on a first die of the sixth pair are selected from the group consisting of an offside penalty, a shot, a major penalty, and a pass. The action indicia on a second die of the sixth pair are selected from the group consisting of a goal, a miss, and a crease infringement.

Rules of the Game

Each game included in the set of pairs of dice is made for two players. The players begin by choosing a set of dice. The rules are dependent on which set of dice is chosen. Unless indicated in the individual rules, the turn is passed after a player scores such that the next player takes a turn following the same rules used by the other player when rolling the first die.

The Following are the Rules for Soccer

The first player rolls the first die of the first pair of dice. A first dice roll of free kick or shot indicates rolling the second die. A first die roll of handball, offside or foul indicates the second player receives the first die. A first die roll of the pass indicates rolling the first die again.

The first player rolls the second die when indicated to do so by the first die. A second die roll of miss indicates a first dice roll by the second player. A second die roll of goal indicates a point for the first player and a first die roll by the second player. A second die roll of penalty indicates the second die roll by the first player. The game is played for a pre-determined amount of time chosen by the players, or the players can play up to a certain score or after a certain amount of turns throwing the dice.

The Following are the Rules for Baseball

The first player rolls the first die of the second pair of dice. A first dice roll of hit indicates rolling the second die. A first die roll of catch or strike three indicates the second player receiving the first die. A first roll die of the strike one or strike two indicates rolling the first die again.

The first player rolls the second die when indicated. A second die roll of first base or second base indicates the first player rolls the first die. A second die roll of home run indicates a point for the first player and the first player rolling the first die. A second die roll of run out indicates the second player rolling the first die. The game is played for nine innings.

The Following are the Rules for Basketball

The first player rolls the first die of the third pair of dice. A first dice roll of shot indicates rolling the second die. A first die roll of penalty or foul indicates second player rolls the second die once. A first die roll of bad foul indicates the second player rolls the second die twice. A first die roll of dangerous foul indicates the second player rolls the second die three times.

The first player rolls the second die when indicated. A second die roll of long range basket indicates three points for the first player. A second die roll of short range basket indicates two points for the first player. A second die roll of miss or air-ball indicates the second player rolls the first die. A second die roll of basket indicates one point for the first player. The game is played for a pre-determined amount of time chosen by the players, or the players can play up to a certain score or after a certain amount of turns throwing the dice.

The Following are the Rules for Tennis

The first player rolls the first die of the fourth pair of dice. A first die roll of first serve indicates rolling the first die again. A first die roll of second serve or in bounds indicates rolling the second die. A first die roll of hit net or out of bounds indicates the second player receiving the first die. A first die roll of ace indicates a point for the first player and the first player rolls the first die again.

The first player rolls the second die when indicated. A second die roll of out of bounds or hit net indicates the second player rolls the first die. A second die roll of ace indicates a point for the first player and the first player rolls the first die again. The player first gaining four points wins a game. The player first gaining six games wins a set. The player first winning three sets wins the match.

The Following are the Rules for Football

The first player rolls the first die of the fifth pair of dice. A first die roll of receive pass or downed ball indicates rolling the first die again. A first die roll of safety indicates the two points for the second player and the second player rolls the first die. A first die roll of failed fourth down indicates the second player rolling the first die. A first die roll of going for touchdown indicates rolling the second die.

The first player rolls the second die when indicated. A second die roll of touchdown indicates six points and rolling the second die again. A second roll of the second die showing place kick indicates a point for the first player and a second roll of the second die showing extra point conversion or passing point conversion indicates two points for the first player. A first roll of the second die showing place kick, extra point conversion or passing point conversion indicates the second player rolls the first die and the first player gains no points. A second die roll of field goal indicates three points for the first player. The game is played for a pre-determined amount of time chosen by the players, or the players can play up to a certain score or after a certain amount of turns throwing the dice.

The Following are the Rules for Hockey

The first player rolls the first die of the sixth pair of dice. A first die roll of shot indicates rolling the second die. A first die roll of pass indicates rolling the first die again. A first die roll of offside penalty indicates the second player throws the first die. A first die roll of major penalty indicates a second die roll by the second player.

The first player rolls the second die when indicated. A second die roll of crease infringement indicates a first die roll by the second player. A second die roll of miss indicates a roll of the first die by the second player. A second die roll of goal indicates a point for the first player. The game is played for a pre-determined amount of time chosen by the players, or the players can play up to a certain score or after a certain amount of turns throwing the dice.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a dice game, said method comprising the steps of:

providing a pair dice, each of said dice having action indicia thereon representative of a game of soccer, said action indicia on a first die of said first pair being selected from a group consisting of a free kick, an offside, a shot, a handball, a foul, and a pass, said action indicia on a second die of said first pair being selected from a group consisting of a penalty, a goal, and a miss;

wherein upon selecting said first pair of dice said players use soccer rules, said soccer rules comprising:

said first player rolling said first die of said first pair of dice, a first dice roll of said free kick or said shot indicating rolling said second die, a first die roll of said handball, said offside or said foul indicating said second player receiving said first die, a first die roll of said pass indicating rolling said first die again; and said first player rolling said second die when indicated, a second die roll of said miss indicating a first dice roll by said second player, a second die roll of said goal indicating a point for said first player and a first die roll by said second player, a second die roll of penalty indicating said second die roll by said first player, wherein said game is played for a pre-determined amount of time, said predetermined amount of time chosen by said players.

2. A method of playing a dice game, said method comprising the steps of:

providing a pair of dice, each of said dice having action indicia thereon representative of a game of baseball, each of said dice being a six sided die, said action indicia on a first die of said second pair being selected from a group consisting of a first strike, a second strike, a third strike, a hit, and a catch, said action indicia on a second die of said second pair being selected from a group consisting of a home run, a two-base hit, a second-base hit, a force out, and a home run;

wherein upon selecting said pair of dice said players use baseball rules, said baseball rules comprising:

said first player rolling said first die of said second pair of dice, a first dice roll of said hit indicating rolling said second die, a first die roll of said catch or said strike three indicating said second player receiving said first die, a first roll die of said strike one or strike two indicating rolling said first die again; and said first player rolling said second die when indicated, a second die roll of said first base or said second base indicating said first player rolling said first die, a second die roll of said home run indicating a point for said first player and said first player rolling said first die, a second die roll of said run out indicating said second player rolling said first die, wherein said game is played for nine innings.

3. The method of playing a dice game, said method comprising the steps of:

providing a pair of dice, each of said dice having action indicia thereon representative of a game of football, each of said dice of said pair of dice being a six sided die, said action indicia on a first die pair of dice being selected from a group consisting of a pass reception, a downed ball, going for touchdown, a failed fourth down conversion and a safety, said action indicia on a second die of said pair of dice being selected from a group consisting of a field goal, a place kick, a touchdown, a passing point conversion, and an extra point conversion;

wherein upon selecting said pair of dice said players use football rules, said football rules comprising:

said first player rolling said first die of said pair of dice, a first die roll of said receive pass or said downed ball indicating rolling said first die again, a first die roll of said safety indicating said two points for said second player and said second player rolling said first die, a first die roll of said failed fourth down indicating said second player rolling said first die, a first die roll of said going for touchdown indicating rolling said second die; and said first player rolling said second die when indicated, a second die roll of said touchdown indicating six points and rolling said second die again, wherein a second roll of said second die indicating said place kick indicates a point for said first player and a second roll of said second die indicating said extra point conversion or said passing point conversion indicates two points for said first player, wherein a first roll of said second die of said place kick, said extra point conversion or said passing point conversion indicates said second player rolling said first die and no gaining of points for said first player, a second die roll of said field goal indicating three points for said first player, wherein said players play said game for a predetermined amount of time decided by said players.

4. The method of playing a dice game according to claim 1, further comprising the step of:

providing a plurality of pairs of dice, wherein said pair of dice having said soccer action indicia thereon defining soccer dice;

wherein a pair of said dice has action indicia thereon representative of a game of basketball and defining basketball dice, each of said basketball dice being a six sided die, said action indicia on a first die of said basketball dice being selected from a group consisting of a foul, a bad foul, a dangerous foul, a penalty, and a shot, said action indicia on a second die of said third pair being selected from a group consisting of a long range basket, a basket, a short range basket, a miss and an air-ball wherein upon selecting said basketball dice said players use basketball rules, said basketball rules comprising:

said first player rolling said first die of said basketball dice, a first dice roll of said shot indicating rolling said second die, a first die roll of said penalty or said foul indicating second player rolling said second die once, a first die roll of said bad foul indicating said second player rolling said second die twice, a first die roll of said dangerous foul indicating said second player rolling said second die three times; and said first player rolling said second die when indicated, a second die roll of said long range basket indicating three points for said first player, a second die roll of said short range basket indicating a two points for said first player, a second die roll of said miss or said air-ball indicating said second player rolling said first die, a second die roll of said basket indicating one point for said first player, wherein said game is played for a pre-determined amount of time chosen by said players.

5. The method of playing a dice game according to claim 2, further comprising the step of:

providing a plurality of pairs of dice, wherein said pair of dice having said baseball action indicia thereon defining baseball dice;

wherein a pair of said dice has action indicia thereon representative of a game of tennis and defining tennis dice, each of tennis dice being a six sided die, said action indicia on a first die of said tennis dice being selected from a group consisting of a first serve, a second serve, a hit net, an in bounds shot, an out of bounds shot and an ace, said action indicia on a second die of said tennis dice being selected from a group consisting of an ace, an out of bounds shot, a point, and a hit net;

wherein upon selecting said tennis dice said players use tennis rules, said tennis rules comprising:

said first player rolling said first die of said tennis dice, a first die roll of said first serve indicating rolling said first die again, a first die roll of said second serve or said in bounds shot indicating rolling said second die, a first die roll of said hit net or said our of bounds indicating said second player receiving said first die, a first die roll of said ace indicating a point for said first player and said first player rolling said first die again; and said first player rolling said second die when indicated, a second die roll of said out of bounds or said hit net indicating said second player rolling said first die, a second die roll of said ace indicating a point for said first player and said first player rolling said first die again, wherein the player first gaining four points wins a game, wherein the player first gaining six games wins a set, wherein the player first winning three sets wins the match.

6. The method of playing a dice game according to claim 3, further comprising the step of:

providing a plurality of pairs of dice, wherein said pair of dice having said football action indicia thereon defining soccer dice;

wherein a pair of said dice has action indicia thereon representative of a game of hockey and defining hockey dice, each of said dice of said hockey dice being a six sided die, said action indicia on a first die of said hockey dice pair being selected from a group consisting of an offside penalty, a shot, a major penalty, and a pass, said action indicia on a second die of said hockey dice being selected from a group consisting of a goal, a miss, and a crease infringement;

wherein upon selecting said hockey dice said players use hockey rules, said hockey rules comprising:

said first player rolling said first die of said hockey dice, a first die roll of said shot indicating rolling said second die, a first die roll of said pass indicating rolling said first die again, a first die roll of said offside penalty indicating said second player throwing said first die, a first die roll of major penalty indicating a second die roll by said second player; and said first player rolling said second die when indicated, a second die roll of said crease infringement indicating a first die roll by said second player, a second die roll of said miss indicating a roll of said first die by said second player, a second die roll of said goal indicating a point for said first player, wherein said game is played for a predetermined amount of time chosen by said players.

* * * * *